US010337215B2

(12) United States Patent
Dragon et al.

(10) Patent No.: US 10,337,215 B2
(45) Date of Patent: Jul. 2, 2019

(54) MOTOR VEHICLE DOOR LOCK

(71) Applicant: Kiekert AG, Heiligenhaus (DE)

(72) Inventors: Marek Dragon, Waldbröl (DE); Alexander Grossmann, Essen (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 15/517,556

(22) PCT Filed: Sep. 24, 2015

(86) PCT No.: PCT/DE2015/100401

§ 371 (c)(1),
(2) Date: May 19, 2017

(87) PCT Pub. No.: WO2016/055054

PCT Pub. Date: Apr. 14, 2016

(65) Prior Publication Data

US 2017/0275929 A1 Sep. 28, 2017

(30) Foreign Application Priority Data

Oct. 7, 2014 (DE) ..... 10 2014 114 512

(51) Int. Cl.
*E05B 79/08* (2014.01)
*E05B 85/02* (2014.01)
*E05B 17/00* (2006.01)

(52) U.S. Cl.
CPC ..... *E05B 79/08* (2013.01); *E05B 17/0012* (2013.01); *E05B 85/02* (2013.01)

(58) Field of Classification Search
CPC ..... E05B 79/08; E05B 85/02; E05B 79/10; Y10T 292/62; Y10T 292/03;
(Continued)

(56) References Cited

U.S. PATENT DOCUMENTS 2,687,637 A * 8/1954 Jacobi ..... E05B 1/0038 70/224
3,002,369 A * 10/1961 Chanaryn ..... E05B 85/24 292/221
(Continued)

FOREIGN PATENT DOCUMENTS

CN 102362041 A 2/2012
DE 195 27 837 A1 2/1997
(Continued)

OTHER PUBLICATIONS

International Search Report and Written Opinion for corresponding Patent Application No. PCT/DE2015/100401 dated Mar. 18, 2016.
(Continued)

*Primary Examiner* — Nathan Cumar
(74) *Attorney, Agent, or Firm* — Renner, Otto, Boisselle & Sklar, LLP

(57) ABSTRACT

The invention relates to a motor vehicle door lock (1) comprising: a lock housing (2); an actuating nut (3) that is rotatably mounted in the lock housing (2), the actuating nut (3) being mounted in the lock housing (2) such that said actuating nut can be rotated by an actuator acting externally on the actuating nut (3); and a locking lever (7), the locking lever (7) being displaceable by means of a rotation of the actuating nut (3). The actuating nut (3) can be positioned in the lock housing by means of a housing cover (25).

16 Claims, 3 Drawing Sheets

Figure 1:
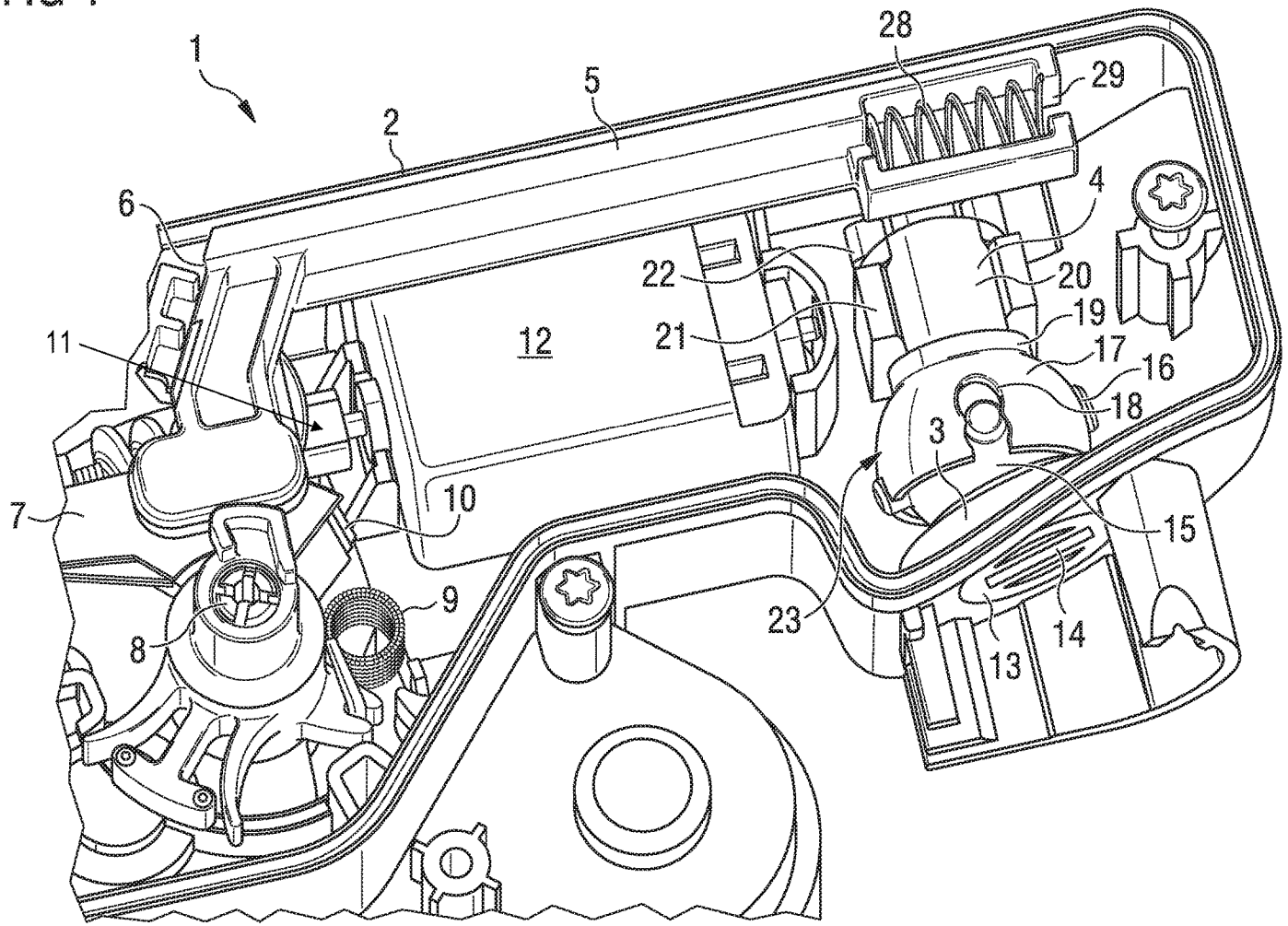

(58) Field of Classification Search
CPC ..... Y10T 292/1078; Y10T 292/1082; Y10S 292/23; Y10S 292/65
USPC ..... 292/337, 1, 198, 201, DIG. 23, DIG. 65
See application file for complete search history.

(56) References Cited

U.S. PATENT DOCUMENTS 3,143,874 A 8/1964 Jacobi
3,385,620 A * 5/1968 Porvin ..... E05B 83/36 292/280
4,014,195 A * 3/1977 Grogan ..... E05B 17/041 403/353
4,237,709 A * 12/1980 Krugener ..... E05B 13/005 292/5
4,565,994 A * 1/1986 Mochida ..... E05B 45/06 200/61.64
5,566,562 A * 10/1996 Fujii ..... E05B 17/04 70/262
6,824,177 B1 * 11/2004 Nass ..... E05B 81/16 292/201
7,703,310 B2 * 4/2010 Usuzaki ..... E05B 17/041 292/125
8,262,143 B2 * 9/2012 Giacomin ..... E05B 17/041 292/201
8,720,240 B2 * 5/2014 Flandrinck ..... E05B 17/041 70/237
2002/0184931 A1 * 12/2002 Wittwer ..... E05B 17/042 70/237
2004/0069028 A1 * 4/2004 Dimig ..... E05B 83/36 70/277
2011/0088436 A1 * 4/2011 Cioni ..... E05B 65/46 70/85
2012/0000258 A1 * 1/2012 Akizuki ..... E05B 81/06 70/91
2016/0102484 A1 * 4/2016 Iotti ..... E05B 79/22 292/195
2017/0298658 A1 * 10/2017 Dragon ..... E05B 77/265

FOREIGN PATENT DOCUMENTS

DE 197 20 476 A1 11/1998
EP 0722028 A1 * 7/1996 ..... E05B 17/041
EP 0856623 A1 * 8/1998 ..... E05B 17/041
EP 0943759 A1 * 9/1999 ..... E05B 17/041
EP 1279783 A1 * 1/2003 ..... E05B 17/04
FR 1175848 A * 4/1959 ..... E05B 17/041
FR 2849885 A1 * 7/2004 ..... E05B 17/041
GB 471141 A * 8/1937 ..... E05B 85/10

OTHER PUBLICATIONS

Office Action of CN Application No. 2015800541999 dated Oct. 9, 2018 (with English Translation).

* cited by examiner

MOTOR VEHICLE DOOR LOCK

The invention relates to a motor vehicle door latch with a latch housing, a switching nut pivotably accommodated in the latch housing, whereby the switching nut is accommodated in the housing in such a way that the switching nut is pivotable by means of an setting means element acting externally on the switching nut and a locking lever, whereby the locking lever is adjustable by means of a rotating movement of the switching nut.

In contemporary motor vehicles, in lateral doors for example, locking cylinders are usually provided which can be operated using a key. The purpose of this mechanical operation is to unlock the locked motor vehicle or vice versa to lock the unlocked vehicle. Mechanical locking and/or unlocking is performed hereby by means of rotating of the locking cylinder. For the transmission of the rotational movement of the locking cylinder to the motor vehicle door latch, it is known to use connecting shafts or to transmit the rotational movement via setting means, for example in the form of a contact plate. The connecting shaft and/or contact plate hereby enable compensation for play between the locking cylinder and the motor vehicle door latch.

Rotational components, which can also be termed switching nuts, are then used to incorporate the rotational movement or torque in the motor vehicle door latch. The connecting shaft or the setting means engages into the switching nut. The switching nut is then preferably accommodated into the housing of the door latch in a torque-proof manner.

A connecting component for a connection between a locking cylinder and a motor vehicle door latch is known from DE 197 20 476 A1. The connecting component is formed as a paddle with a sprocket. Protrusions are located at either end of this connecting component which enable form fitting for force transmission between the locking cylinder and the door latch. The connecting component is thus inserted into a cylinder core of the locking cylinder in a form-fitting manner and fixed and positioned by means of a securing component. In addition to the protrusions on the ends, the ends have spherical heads which enable compensation of tolerance and play between the locking cylinder and the door latch.

A motor vehicle door latch system with a latch unit and a locking cylinder unit is known from DE 195 27 837 A1. A connecting shaft is arranged between the locking cylinder and the door latch to transmit the torque introduced into the door latch. Spherical head-shaped elements are formed as wings which are inserted into nuts in a form-fitting manner on both sides at the ends of the connecting component. The switching nuts have towing arm elements for the transmission of the rotational movement interacting with the wings of the connecting shaft. Thus, tolerance offsetting is possible on the one hand and a torque can be transmitted on the other hand. The switching nut is held in a torque-proof manner on the door latch side between a latch housing and a latch lid. The switching nut haves an extension with a recess. Consequently, a locking lever in the door latch can be operated via the recess during a rotational movement of the switching nut.

A perennial problem in the configuration of locking systems is that tolerances add up over the operation chain. A transmission chain as play-free as possible is striven towards, whereby the freedom from play is limited in that easy operation of the door latch is desired and the components are needed to be arranged in a movable manner. A further problem which results in the configuration and in particular the arrangement of the locking cylinders or door latch components is that movements in or on the door latch need to be deflected. Deflection and/or bearing points reduce the ease of operation, complicate assembly and can impair functionality.

The invention is based on the task of improving a motor vehicle door latch and in particular enabling deflection of a rotational movement and easy mounting of a switching nut. Another task of the invention is to provide a cost-effective door latch of a simple construction.

The task is solved according to the invention by the characteristics of the independent claims. Advantageous designs of the invention are stated in the sub-claims. It is to be noted that the design examples described hereafter are not restrictive; instead, any variations are possible of the characteristics described in the description and the sub-claims.

According to patent claim 1, the task of the invention is solved by a motor vehicle door latch with a latch housing, a switching nut pivotably accommodated in the latch housing, whereby the switching nut is accommodated in the housing in such a way that the switching nut is pivotable by means of an setting means element acting externally on the switching nut and a locking lever, whereby the locking lever is adjustable by means of a rotational movement of the switching nut and the switching nut can be positioned via a housing lid in the latch housing. The formation of a motor vehicle door latch according to the invention now gives the option of easily positioning and mounting of a switching nut in the motor vehicle door latch. If the switching nut is positioned by means of the housing lid, i.e. joined into its final position, there is the option of inserting the switching nut into the latch housing with play during mounting. Hereby, degrees of freedom result during mounting which, in turn, have a positive effect on the number of bearing points formed. If the switching nut can be inserted into the latch housing with play and even great play, work can take place with a single bearing point in the housing. After joining into the bearing point, the switching nut can then be inserted into an aperture of the latch housing, for example. Consequently, the switching nut only attains its final position after joining into the bearing point and subsequent shifting. Positioning is performed by means of positioners on the latch lid.

A motor vehicle door latch consists of a latch housing and a latch lid. Usually, crucial components of the motor vehicle door latch, such as locking elements and/or drive motors and/or strip conductors are arranged in the latch housing. The latch housing is then sealed with a latch lid. Consequently, waterproofness and/or dustproofness can be attained. The purpose of the switching nut is to lock or unlock the door latch and it is accommodated in the latch housing in such a way that a setting means and/or a connecting shaft can engage with the switching nut. The switching nut can be rotated by the setting means, whereby a locking lever can be adjusted by means of the rotating movement. The purpose of a locking lever here is to disengage an internal activation and/or an external activation of the door latch.

In one design form of the invention, the switching nut interacts with a transmission lever, whereby the switching nut and the transmission lever interact in such a way that a rotational movement of the switching nut is deflectable into a rotational movement displaced at an angle. On many occasions the switching nut cannot interact directly with a locking lever due to specified spatial conditions in the motor vehicle or the motor vehicle door or tailgate, but it interacts indirectly with the locking lever.

It can also be the case that the switching nut is arranged in the latch housing displaced at an angle to a locking lever. An angular displacement between the switching nut and a contact point of the locking lever then needs to be offset. According to the invention and to this end, the switching nut then interacts with a transmission lever in such a way that the rotational movement of the switching nut is converted into a rotational movement displaced at an angle. By means of the transmission lever it is thus possible on the one hand to bypass distances between the switching nut and the mesh point on the locking lever and on the other hand to offset differences in angles in the alignment of transmission levers and the switching nut.

If the switching nut and the deflection lever are connected by means of a ball joint connection, a further design form of the invention results. The switching nut is accommodated directly in the latch housing. In relation to the latch housing, accommodated means for example that an aperture is contained in the latch housing into which the switching nut is inserted and held at least in places.

The switching nut is accommodated in the latch housing in a torque-proof manner. If a connection is now made between the switching nut and the deflection lever in the form of a ball joint connection, an extremely tolerance-free transmission of a rotational movement of the switching nut and the deflection lever can thus be attained. Furthermore, different angles can be bypassed by means of a ball joint connection. Consequently, manufacturing tolerances can also be offset. A ball joint connection can also be produced cost-effectively.

In a further design form, the transmission lever is accommodated in the latch housing. Accommodation of the transmission lever in the latch housing offers the advantage of only one bearing point needing to be formed in the latch housing. If the switching nut is accommodated into a hole in the latch housing with a cylindrical end, for example, accommodation of the transmission lever combined with the switching nut is thus sufficient for positioning in the latch housing. If the transmission lever is designed as a cylinder in places, for example, a U-shaped bearing point in the latch housing can incorporate the transmission lever in the cylindrical area. The U-shaped bearing point in its axial extension along the cylinder axis of the transmission lever can be shorter than the cylindrical area of the transmission lever. The cylindrical area of the transmission lever thus protrudes over the bearing point. If part of a housing lid, in particular a positioner, now grasps between the bearing point and alongside the cylindrical area of the transmission lever, positioning of the transmission lever in the motor vehicle door latch can be attained in the simplest way possible.

Due to the design of the bearing point in such a way that the bearing point is shorter than the cylindrical area of the transmission lever, mounting of the transmission lever including the switching nut is very easy as the transmission lever can be inserted into the bearing point with play. The play between the bearing point and the transmission lever can be selected in such a way that the play corresponds to the lift which the switching nut protrudes into the latch housing. The transmission lever with the switching nut can thus be inserted into the latch housing and the switching nut can be held in a torque-proof and form-fitting manner in the latch housing. In combination with the latch lid, for positioning of the transmission lever only one bearing point is sufficient to position the switching nut in the motor vehicle door latch in a torque-proof manner.

If the switching nut is accommodated in the latch housing in a form-fitting manner, a further design form of the invention results. After joining into the latch housing, the switching nut can be accommodated in the latch housing in a form-fitting manner. The switching nut has at least two different diameters in the area of the mounting in the latch housing. A lesser diameter is formed at the external end of the switching nut at the end passed through the latch housing to mount a setting means of the locking cylinder. If the switching nut furthermore has at least one further larger diameter connected to the lesser diameter, the switching nut can be securely positioned on the one hand and accommodated in the latch housing in a torque-proof manner on the other hand. Both differing diameters or radii then form a bearing point for the switching nut on the latch housing side together with the latch housing.

The latch housing has an aperture and preferably a cylindrical aperture, for example, in the form of a hole into which the switching nut can be inserted. Consequently, the switching nut is flushly adjacent with an external surface of the latch housing. A form-fitting manner means that the switching nut is pivotably accommodated in the latch housing on the one hand and a bearing point is formed for the switching nut by means of the shape of the switching nut and the corresponding latch housing. The latch housing can thus, for example, have an aperture in the form of a hole and in particular a hole with a uniform diameter into which the cylindrical end of the switching nut can be inserted. If, in addition to the cylindrical end, the switching nut has a further cylindrical section connecting to the cylindrical end which is larger than the part extending through the latch housing, this further section can act as a stop and a guide for the switching nut.

If the switching nut and the transmission lever are connected via a cardanic joint, a further advantageous design of the invention results. A cardanic connection offers the advantage of high guide accuracy, i.e. a rotational movement of the switching nut can be transmitted in an almost play-free manner. Furthermore, the cardanic joint offers the advantage of high positioning reliability for the connection between the switching nut and the transmission lever. Positioning reliability hereby means that a guide for the switching nut can be attained by means of the cardanic joint, in particular for guiding in the bearing point of the latch housing.

A further advantage then results when the transmission lever is formed as a ball socket. If the transmission lever is formed with a ball socket of the cardanic joint, the ball socket can support, position and guide the switching nut.

If the switching nut is then formed as a ball, the transmission lever and the ball socket thus form a bearing point for the switching nut. Secure positioning and fixing of the components is guaranteed by means of the ball socket-shaped mounting of the switching nut in the transmission lever. This offers the advantage that the transmission lever and the switching nut accommodated in the transmission lever can be easily mounted. If the switching nut is inserted into the ball socket of the transmission lever before mounting, the components can be joined together in the latch housing which considerably facilitates mounting of the motor vehicle door latch. In the latch housing itself, the transmission lever mounted in the latch housing then acts as a bearing point for the switching nut which is mounted or held in the ball socket of the transmission lever.

If the ball socket has an indentation, whereby the indentation overlaps the ball of the ball joint connection, a further design form of the invention results. An indentation means that the ball socket extends over a center of the ball of the cardanic joint. Consequently, the ball of the cardanic joint is held in the ball socket to beyond its center. The cardanic joint is then joined by the ball being inserted into the ball socket. The transmission lever with the preformed ball socket is preferably made of an elastomer. Elastomer means that the plastic is designed in such a way that moments and rotational movements are securely transmissible, but also the areas of the ball socket extending beyond the center of the ball which form the indentation elastically deform. Consequently, a form fit can be produced between the ball of the switching nut and the ball socket of the transmission lever. Using an indentation on the ball socket, additional security can be attained in the accommodation of the switching nut in the latch housing and the tolerance sensitivity of the connection can be minimized simultaneously.

In a further execution form of the invention an advantage is then attained when the ball of the ball joint connection haves cylindrical pins which interact with recesses in the ball joint. Cylindrical pin-shaped extensions on the ball of the ball joint connection offer the advantage of the connection between the transmission lever and the switching nut being executed with very little effort and thus very cost-effectively. The cylindrical pins engage in recesses in the ball joint, whereby a play-free transmission of a torque or a rotational movement is facilitated. Furthermore, by the cylindrical pin-shaped formation of the extensions a favorable engagement relationship can be achieved between the switching nut and the transmission lever.

With the ball joint or the contact surfaces on the recesses of the ball joint the cylindrical pins form a point contact or, in relation to their lengthwise extension, a linear contact which has a favorable impact on the transmission in particular of movements via an angular displacement. This means when the switching nut in the latch housing is arranged at a displaced angle to the central axis of the transmission lever, secure transmission of a rotational movement or a torque can be guaranteed at any time by means of the cylindrical pin-shaped connection between the ball and the ball socket.

In a preferred design form four cylindrical pins are arranged circumferentially and at regular intervals, in particular displaced by 90°. A regular arrangement of the cylindrical pins on the circumference of the balls of the switching nut enables secure positioning of the switching nut in the latch housing and simultaneously secure transmission through the switching nut into the transmission element or the transmission lever. A regular, i.e. symmetrical construction of the ball joint connection enables the same engagement relationships to be attained at any time. On the one hand, identical engagement relationships can be executed and, on the other hand, the cylindrical pins position and guide the switching nut by means of the transmission lever. Consequently, by means of the symmetrical, i.e. regular construction of the ball joint connection secure guidance is also guaranteed during mounting of the components in the latch housing.

If the recesses has a changing opening width, a further arrangement of the invention results. A changing opening width can be executed, for example, in such a way that the recesses in the ball socket initially increase starting from an external end and then decrease again and then have a larger opening width again. It can hereby be guaranteed that the cylindrical pins are adjacent to the recesses at all times and in such a way that in particular in the case of angular offsetting at least three cylindrical pins are always engaged with the recesses. Thus, by means of the cylindrical pin-shaped extensions on the ball of the switching nut and the recesses changing in width, a play-free transmission of a torque or a rotational movement can always be guaranteed. The different opening widths are preferably formed by different radii on the transmission lever.

If a towing arm is present, whereby the towing arm is adjustable using the deflection lever and the towing arm interacts with the locking lever, a further design form of the invention results. A towing arm interacts with the transmission lever and forms a further connecting element for transmission of the rotational movement of the locking cylinder, the resulting rotational movement of the switching nut and the subsequent rotational movement of the transmission lever which then moves the towing arm in turn. The operation chain described above through the latch enables the locking unit to also operate on an area in the door latch which is not directly accessible for the switching nut. The towing arm is preferably formed as a slider making linear movements in the motor vehicle door latch.

The transmission lever can have two spaced extensions to operate the towing arm which, in turn, encompass at least one setting means formed on the towing arm. By means of the overlapping of the extensions formed on the transmission lever, a rotational movement of the transmission lever can thus be transposed into a linear movement of the towing arm. The towing arm is formed as a linear sliding element in the motor vehicle door latch and is accommodated in a linearly moving manner. At least one setting means interacts with the transmission lever or reaches into the movement area of the transmission lever. Consequently, a rotational movement of the transmission lever can be transmitted by means of the extensions formed on the towing arm. The circular movement of the extensions on the transmission lever is transmitted by means of the setting means on the towing arm into a linear movement of the towing arm.

In a preferred design form the towing arm has a mounting for a spring, and in particular a compression spring. The transmission lever executes a rotational movement which is transmissible via the extensions and a setting means formed on the towing arm into a linear movement of the towing arm. In order to always displace the towing arm into its initial position again, according to the invention a spring element is used which moves the towing arm back into a zero position. By means of the switching nut and consequently the transmission lever the motor vehicle door latch can be transferred from a locked state to an unlocked state or from an unlocked state to a locked state. For every position of the motor vehicle latch, i.e. unlocked or locked, the towing arm must be moved in a different direction. The starting position and zero position of the towing arm forms a position in which neither the unlocked nor the locked state is present, but the towing arm moves into a zero position from which the operational states of the motor vehicle latch can be executed.

In one design form, the spring interacts with stops on the housing lid. In this preferred design form, it is possible to use the spring as a center-zero spring, which is preferably a compression spring. A center-zero spring describes a spring which maintains an setting means in a central position, whereby deflection from this center-zero position causes tensioning of the springs.

Consequently, after operation of the setting means, such as the towing arm, for example, the setting means is returned to the center-zero position. If the towing arm has a mounting which contains apertures, into which stops of the housing lid can be moved, a center-zero spring can be simulated by means of the compression spring. This offers both a cost advantage and also a cost-effective structural solution for the configuration of a setting means for operating locking of a motor vehicle door latch.

The invention is described in further detail below with reference to the attached drawings on the basis of the preferred design forms. However, the principle applies that the design example does not limit the invention, but only constitutes an advantageous design form. The characteristics depicted can be executed individually or in combination, individually or in combination with other characteristics of the description, as also of the patent claims.

Figure 2:
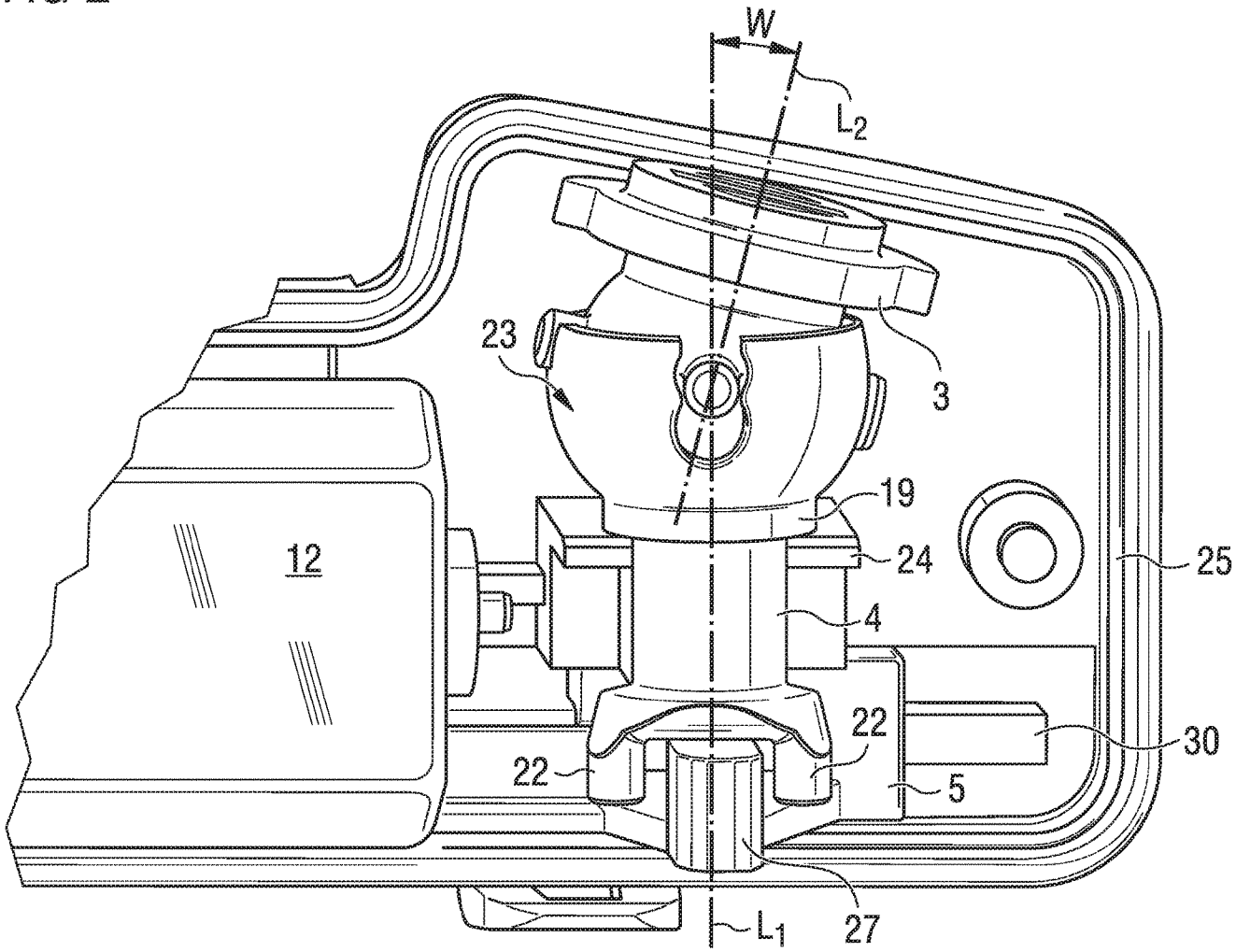
Figure 3:
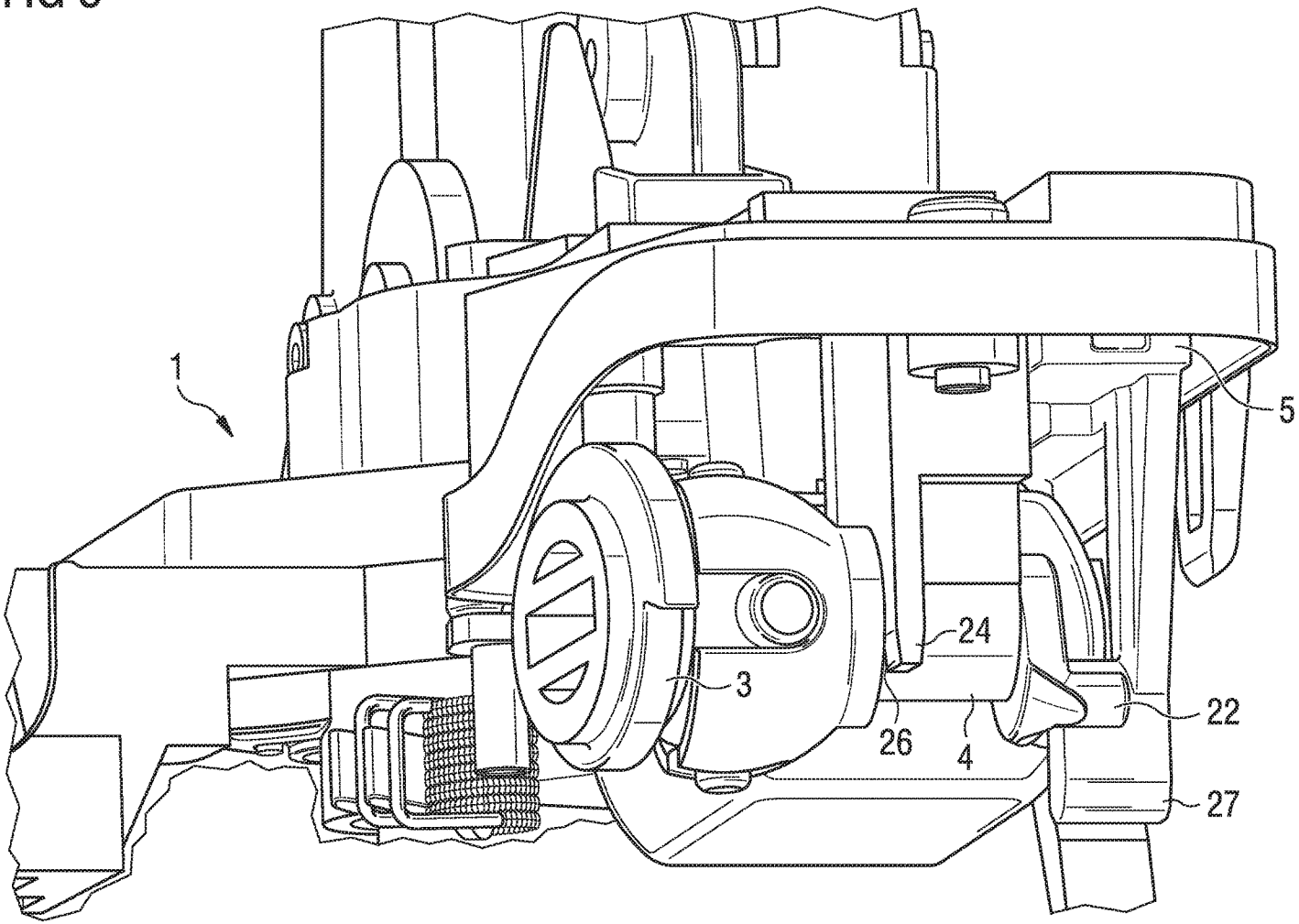

The following are shown:

FIG. 1 a top view of a latch housing with an integrated operation chain starting from a switching nut via a transmission lever, a towing arm for the locking lever, whereby the motor vehicle door latch is depicted without a latch lid, FIG. 2 a view of a housing lid with the operating chain switching nut, transmission lever, towing arm and FIG. 3 a further view of the housing lid with the operation chain switching nut, transmission lever and towing arm in the installation position.

FIG. 1 reproduces a motor vehicle door latch 1 in a view on the latch housing 2. A switching nut 3 is accommodated in a torque-proof manner in the latch housing 2, whereby the switching nut 3 interacts with a transmission lever 4 and the transmission lever 4 engages with a towing arm 5. The towing arm 5 is accommodated in the latch housing 2 in a linearly shiftable manner. The towing arm 5 interacts with a locking lever 7 at one end of the towing arm 5, whereby the locking lever 7 is pivotably accommodated on an axis 8 in the latch housing 2. The locking lever 7 is pre-tensioned via a spring element 9. The locking lever 7 also has a gearwheel segment 10 which engages into a wormgear 11 of a motor 12. The purpose of the motor 12 is to perform electromechanical unlocking or locking.

The switching nut 3 is held flush in the latch housing 2 and accommodated by the latch housing 2 in a form-fitting and torque-proof manner. An axial end of the switching nut 3 ends flush with the latch housing 2. In this design example, the switching nut 3, in particular the axial end 13 is of a cylindrical design. The switching nut 3 haves a rectangular recess 14 into which a non-illustrated setting means of a locking cylinder can engage. A larger diameter is connected to the diameter of the axial end 13 of the switching nut 3 which is adjacent to the latch housing 2 and is thus able to guide the switching nut 3 so that the switching nut 3 forms a bearing point with the latch housing 2.

A ball-shaped head 15 is formed integrally on the larger diameter of the switching nut 3 which has cylindrical pins 16. The ball-shaped head 15 and the cylindrical pins 16 are accommodated in a ball socket 17 with recesses 18. A cylindrical-shaped section 19 is connected to the ball socket 17. The transmission lever 4 also has a cylinder 20 which is accommodated in a bearing point 21 of the latch housing 2. Furthermore, extensions 22 are formed on the cylinders 20 of the transmission lever 4.

If a setting means now acts on the switching nut 3, whereby in particular an setting means engages into the recess 14 of the switching nut 23, the rotary movement of the switching nut 3 is transmitted to the transmission lever 4 by means of the ball joint connection 23. The extensions 22 on the transmission lever 4 then perform a circular movement, whereby the towing arm 5 is shifted in a linear manner. A linear movement of the towing arm 5 leads to the locking lever 7 being adjusted. This consequently enables unlocking or locking of the motor vehicle door latch 1.

It is clearly apparent in FIG. 1 that the cylindrical section 19 is held in the latch housing 2 at a distance from the bearing point 21. The bearing point 21 accommodates the transmission lever 4 but does not position the switching nut 3 in the latch housing 2. Bracing of the cylindrical-shaped section 19 of the transmission lever is vital for positioning of the switching nut.

The cylindrical section 19 of the transmission lever 4 is braced by means of positioners 24 as illustrated in FIG. 2, formed integrally with a latch lid 25 in this design example. The positioners 24 are formed as extensions of the latch lid 25 and engage between the cylindrical-shaped section 19 of the transmission lever 4 and the bearing point 21 in the latch housing 2. The positioners 24 position the switching nut 3 and the transmission lever 4 securely in the motor vehicle door latch 1. Torque-proof accommodation of the switching nut 3 in the motor vehicle door latch 1 is thus only enabled by the positioners 24.

As can furthermore be detected from FIG. 2, the transmission lever 4 has a lengthwise axis L 1 which is aligned displaced at an angle W to a lengthwise axis L 2 of the switching nut 3. According to the invention, the cardanic ball joint connection 23 enables offsetting of the angular displacement W between the switching nut 3 and the transmission lever 4.

FIG. 3 depicts a further three-dimensional view of the switching nut 3 and the transmission lever 4. The switching nut 3 is depicted without the latch housing 2 but in an installed position in the motor vehicle door latch 1, whereby the positioners 24 are clearly apparent. The positioners 24 have bevels 26 which facilitate positioning of the transmission lever 4 and thus the switching nut 3 in the motor vehicle door latch 1.

Extensions 22 act on a setting means 27, formed from a formed extension of the towing arm 5. A linear movement of the towing arm 5 is performed from a rotational movement of the transmission lever 4 with the interplay of the transmission lever 4 or the extensions 22 and the setting means 27. The towing arm 5 is reset via the spring 28 which is executed as a compression spring and which interacts via apertures 29 with stops 30, see in particular FIGS. 1 and 2. Two apertures 29 are arranged in the towing arm 5 which interact with corresponding stops 30 formed on the latch lid 25.

| Reference sign list | |
|---|---|
| Motor vehicle door latch | 1 |
| Latch housing | 2 |
| Switching nut | 3 |
| Transmission lever | 4 |
| Towing arm | 5 |
| End of towing arm | 6 |
| Locking lever | 7 |
| Axis | 8 |
| Spring element | 9 |
| Gearwheel segment | 10 |
| Worm | 11 |
| Motor | 12 |
| Axial end of the switching nut | 13 |
| Recess | 14 |
| Ball-shaped head | 15 |
| Cylindrical pins | 16 |
| Ball socket | 17 |
| Recesses | 18 |
| Cylindrical-shaped section | 19 |
| Cylinder | 20 |
| Bearing point | 21 |
| Extensions | 22 |
| Ball joint connection | 23 |

-continued

| Reference sign list | |
|---|---|
| Positioner | 24 |
| Latch lid | 25 |
| Bevels | 26 |
| Setting means | 27 |
| Spring | 28 |
| Apertures | 29 |
| Stops | 30 |
| Angle, angular displacement | W |
| Lengthwise axis transmission lever | L1 |
| Lengthwise axis switching nut | L2 |

The invention claimed is:

1. A motor vehicle door latch comprising:

a latch housing;

a switching nut that is pivotably disposed in the latch housing;

a locking lever that is moveable for locking and unlocking the motor vehicle door latch;

a transmission lever that is connected to the switching nut, the switching nut and the transmission lever being positionable for rotational movement in the latch housing;

a linear movement element connected between the transmission lever and the locking lever; and a ball joint connection that connects the switching nut and the transmission lever by way of a ball-shaped head and a ball socket that receives the ball-shaped head, whereby rotational movement of the switching nut is transmitted to rotational movement of the transmission lever and the rotational movement of the transmission lever is transferred to linear movement of the linear movement element which engages the locking lever to pivot the locking lever, wherein a rotational axis of the switching nut is deflectable at an angle relative to a rotational axis of the transmission lever.

2. The motor vehicle door latch according to claim 1, wherein the switching nut and the transmission lever interact such that the rotational movement of the switching nut is deflectable at an angle relative to the rotational movement of the transmission lever.

3. The motor vehicle door latch according to claim 1, wherein the ball-shaped head of the ball joint connection is formed integrally on the switching nut or the transmission lever.

4. The motor vehicle door latch according to claim 1, wherein the transmission lever is supported in the latch housing.

5. The motor vehicle door latch according to claim 1, wherein the latch housing has a housing lid that includes positioners formed integrally with the housing lid, whereby the transmission lever is rotatably supported by the positioners in the latch housing.

6. The motor vehicle door latch according to claim 1, wherein the switching nut is accommodated in the latch housing in a form-fitting manner.

7. The motor vehicle door latch according to claim 1, wherein the ball joint connection has a cylindrical-shaped section that is connected to the ball socket and the transmission lever has a cylinder that is connected to the cylindrical-shaped section.

8. The motor vehicle door latch according to claim 1, wherein the transmission lever is formed as the ball socket.

9. The motor vehicle door latch according to claim 1, wherein the ball socket has at least one recess, whereby the at least one recess overlaps the ball-shaped head of the ball joint connection.

10. The motor vehicle door latch according to claim 9, wherein the ball-shaped head of the ball joint connection has at least one cylindrical pin which interacts with the at least one recess in the ball socket.

11. The motor vehicle door latch according to claim 10, wherein the ball-shaped head has four cylindrical pins that are arranged circumferentially and at regular intervals, the four cylindrical pins being displaced by 90°.

12. The motor vehicle door latch according to claim 9, wherein the at least one recess has a changing opening width.

13. The motor vehicle door latch according to claim 1, wherein the linear movement element is a towing arm that is connected between the transmission lever and the locking lever.

14. The motor vehicle door latch according to claim 13, wherein the towing arm has a mounting for a compression spring.

15. The motor vehicle door latch according to claim 14 further comprising the compression spring, wherein the compression spring interacts with stops on a housing lid of the latch housing.

16. A motor vehicle door latch comprising:

a latch housing;

a switching nut that is pivotably disposed in the latch housing;

a locking lever that is moveable for locking and unlocking the motor vehicle door latch;

a transmission lever that is connected between the locking lever and the switching nut, the switching nut and the transmission lever being positionable for rotational movement in the latch housing; and a ball joint connection that connects the switching nut and the transmission lever by way of a ball-shaped head and a ball socket that receives the ball-shaped head, the ball-shaped head having at least one radially protruding pin which interacts with at least one recess in the ball socket, whereby rotational movement of the switching nut is transmitted to rotational movement of the transmission lever, wherein a rotational axis of the switching nut is deflectable at an angle relative to a rotational axis of the transmission lever.

* * * * *